US009637852B2

(12) United States Patent
Song et al.

(10) Patent No.: US 9,637,852 B2
(45) Date of Patent: May 2, 2017

(54) LAUNDRY TREATMENT MACHINE AND METHOD OF OPERATING THE SAME TO DETERMINE LAUNDRY POSITION

(71) Applicant: LG ELECTRONICS INC., Seoul (KR)

(72) Inventors: Hamin Song, Changwon-si (KR); Hansu Jung, Changwon-si (KR); Hoonbong Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 501 days.

(21) Appl. No.: 14/067,762

(22) Filed: Oct. 30, 2013

(65) Prior Publication Data

US 2014/0115793 A1 May 1, 2014

(30) Foreign Application Priority Data

Oct. 31, 2012 (KR) ..... 10-2012-0122446

(51) Int. Cl.
*D06F 37/20* (2006.01)
*D06F 33/02* (2006.01)

(52) U.S. Cl.
CPC ..... *D06F 37/203* (2013.01); *D06F 33/02* (2013.01); *D06F 2202/10* (2013.01); *D06F 2204/065* (2013.01); *D06F 2222/00* (2013.01)

(58) Field of Classification Search
CPC ..... D06F 37/203; D06F 2204/065; D06F 2202/10
See application file for complete search history.

(56) References Cited

U.S. PATENT DOCUMENTS

| | | | | |
|---|---|---|---|---|
| 7,471,054 | B2 * | 12/2008 | Marioni | D06F 33/02 318/268 |
| 7,788,755 | B2 * | 9/2010 | Lee | D06F 37/22 68/12.02 |
| 2003/0167577 | A1 | 9/2003 | Stalsberg | |
| 2006/0242768 | A1 | 11/2006 | Zhang et al. | |
| 2007/0039104 | A1 | 2/2007 | Lee et al. | |
| 2009/0300852 | A1 * | 12/2009 | Bae | D06F 35/007 8/159 |
| 2012/0303163 | A1 | 11/2012 | Compains Pascualena et al. | |

FOREIGN PATENT DOCUMENTS

| | | | |
|---|---|---|---|
| CN | 1854377 | A | 11/2006 |
| DE | 10 2010 002 048 | A1 | 8/2011 |
| EP | 2 175 061 | A1 | 4/2010 |
| KR | 10-2009-0085748 | | 8/2009 |
| KR | 1020110014433 | A | 2/2011 |
| KR | 10-2011-0023061 | | 3/2011 |
| KR | 10-1100317 | | 12/2011 |
| WO | 2004/111324 | A1 | 12/2004 |

* cited by examiner

*Primary Examiner* — Michael Barr
*Assistant Examiner* — Rita Adhlakha
(74) *Attorney, Agent, or Firm* — Dentons US LLP

(57) ABSTRACT

Disclosed are a laundry treatment machine and a method of operating the same. The method of operating a laundry treatment machine includes rotating a drum at a first velocity, forcibly vibrating the drum using a forced vibration generation signal during a first velocity rotating section, and determining whether to accelerate or decelerate the drum after forced vibration. Through this method, laundry position may be determined.

13 Claims, 15 Drawing Sheets

LAUNDRY TREATMENT MACHINE AND METHOD OF OPERATING THE SAME TO DETERMINE LAUNDRY POSITION

CROSS-REFERENCE TO RELATED APPLICATION

This application claims the priority benefit of Korean Patent Application No. 10-2012-0122446 filed on Oct. 31, 2012, in the Korean Intellectual Property Office, the disclosure of which is incorporated herein by reference in its entirety.

BACKGROUND OF THE INVENTION

1. Field of the Invention

The present invention relates to a laundry treatment machine and a method of operating the same, and more particularly to a laundry treatment machine in which laundry position is determinable and a method of operating the laundry treatment machine.

2. Description of the Related Art

In general, laundry treatment machines implement laundry washing using friction between laundry and a tub that is rotated upon receiving drive power of a motor in a state in which detergent, wash water, and laundry are introduced into a drum. Such laundry treatment machines may achieve laundry washing with less damage to laundry and without tangling of laundry.

A variety of methods of sensing amount of laundry have been discussed because laundry treatment machines implement laundry washing based on amount of laundry.

SUMMARY OF THE INVENTION

It is an object of the present invention to provide a laundry treatment machine in which laundry position is determinable and a method of operating the laundry treatment machine.

In accordance with one aspect of the present invention, the above and other objects can be accomplished by the provision of a method of operating a laundry treatment machine, the method including rotating a drum at a first velocity, forcibly vibrating the drum using a forced vibration generation signal during a first velocity rotating section, and determining whether to accelerate or decelerate the drum after forced vibration.

In accordance with another aspect of the present invention, there is provided a laundry treatment machine including a drum, a motor configured to rotate the drum, a drive unit configured to rotate the drum at a first velocity and to forcibly vibrate the drum using a forced vibration generation signal during a first velocity rotating section, and a controller configured to determine whether to accelerate or decelerate the drum after forced vibration.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

With respect to constituent elements used in the following description, suffixes "module" and "unit" are given only in consideration of ease in the preparation of the specification, and do not have or serve as specially important meanings or roles. Thus, the "module" and "unit" may be mingled with each other.

Figure 1:
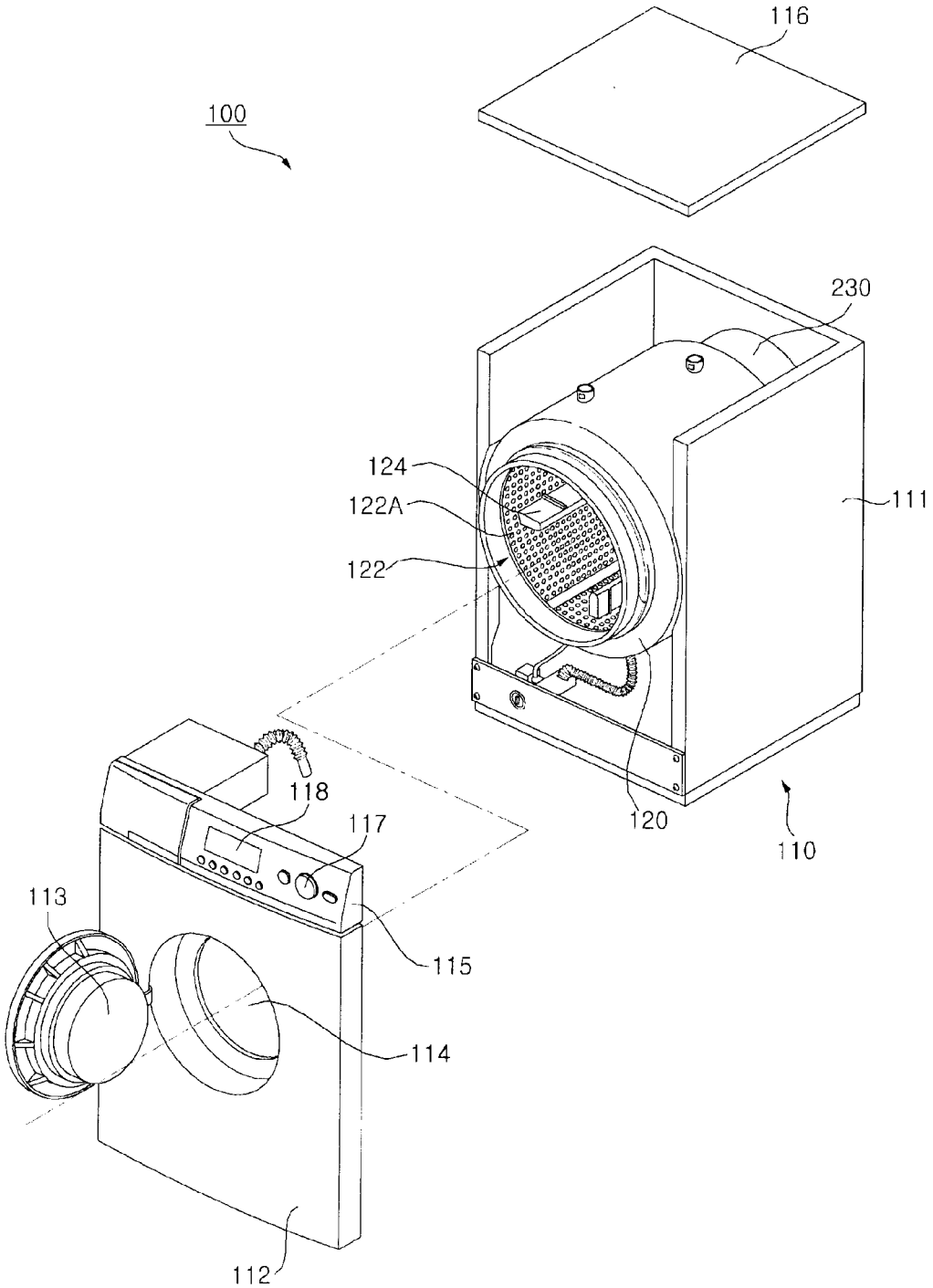
FIG. 1 is a perspective view showing a laundry treatment machine according to an embodiment of the present invention.

FIG. 1 is a perspective view showing a laundry treatment machine according to an embodiment of the present invention.

Figure 2:
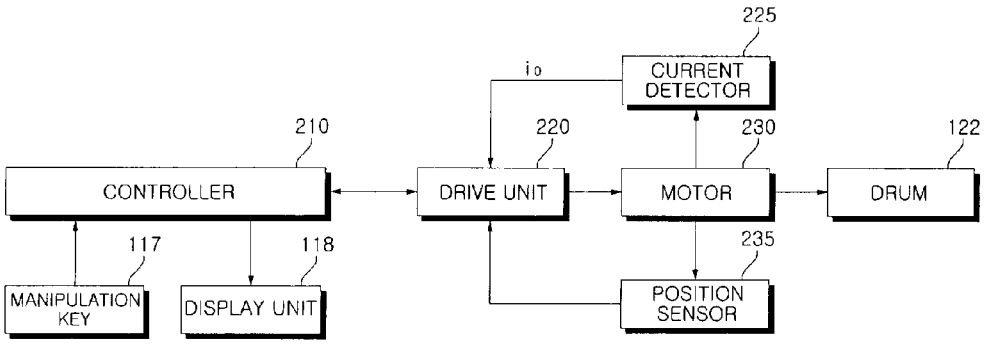
FIG. 2 is an internal block diagram of the laundry treatment machine shown in FIG. 1.

Referring to FIGS. 1 and 2, the laundry treatment machine 100 is a drum type laundry treatment machine, and includes a casing 110 defining the external appearance of the laundry treatment machine 100, a tub 120 placed within the casing 110 and supported by the cabinet 110, a drum 122 placed within the tub 120 to implement laundry washing therein, a motor 230 configured to drive the drum 122, a wash water supply device (not shown) placed at the outside of a cabinet main body 111 to supply wash water into the cabinet 110, and a drain device (not shown) located below the tub 120 to outwardly discharge wash water.

The drum 122 has a plurality of through-holes 122A through which wash water can pass. In addition, the drum 122 may have lifters 124 arranged at an inner surface thereof to lift and drop laundry within a given height range during rotation of the drum 122.

The cabinet 110 includes the cabinet main body 111, a cabinet cover 112 located at and coupled to a front surface of the cabinet main body 111, a control panel 115 located at the top of the cabinet cover 112 and coupled to the cabinet main body 111, and a top plate 116 located at the top of the control panel 115 and coupled to the cabinet main body 111.

The cabinet cover 112 has a laundry introduction/removal opening 114 to allow laundry to be introduced into or removed from the drum 122, and a door 113 installed in a leftward/rightward pivoting manner to open or close the laundry introduction/removal opening 114.

The control panel 115 includes manipulation keys 117 to set an operational state of the laundry treatment machine 100, and a display device 118 located at one side of the manipulation keys 117 to display the operational state of the laundry treatment machine 100.

The manipulation keys 117 and the display device 118 provided at the control panel 115 are electrically connected to a controller (not shown), which electrically controls respective components of the laundry treatment machine 100. Operation of the controller (not shown) will be described later.

The drum 122 may be provided with an auto balancer (not shown). The auto balancer (not shown) serves to attenuate vibration generated in response to unbalance of laundry received in the drum 122. The auto balancer (not shown) may take the form of a liquid balancer or ball balancer, for example.

Although not shown in the drawing, the laundry treatment machine 100 may further include a vibration sensor to measure vibration of the drum 122 or vibration of the cabinet 110.

FIG. 2 is an internal block diagram of the laundry treatment machine shown in FIG. 1.

Referring to FIG. 2, in the laundry treatment machine 100, a drive unit 220 is controlled to drive the motor 230 under control of a controller 210. Thereby, the drum 122 is rotated by the motor 230.

The controller 210 is operated upon receiving an operating signal input by the manipulation keys 117. Thereby, washing, rinsing and dehydration processes may be implemented.

In addition, the controller 210 may control the display device 118 to thereby control display of washing courses, washing time, dehydration time, rinsing time, current operational state, and the like.

The controller 210 controls the drive unit 220 to operate the motor 230. For example, the controller 210 may control the drive unit 220 to rotate the motor 230 based on signals from a current detector 225 that detects output current flowing through the motor 230 and a position sensor 235 that senses a position of the motor 230. The drawing shows detected current and sensed position signals input to the drive unit 220, but the present disclosure is not limited thereto, and the same may be input to the controller 210 or may be input to both the controller 210 and the drive unit 220.

The drive unit 220, which serves to drive the motor 230, may include an inverter (not shown) and an inverter controller (not shown). In addition, the drive unit 220 may further include, e.g., a converter to supply Direct Current (DC) input to the inverter (not shown).

For example, if the inverter controller (not shown) outputs a Pulse Width Modulation (PWM) type switching control signal (Sic of FIG. 3) to the inverter (not shown), the inverter (not shown) may supply a predetermined frequency of Alternating Current (AC) power to the motor 230 via implementation of fast switching.

The drive unit 220 will be described later in greater detail with reference to FIG. 3.

In addition, the controller 210 may function to detect amount of laundry based on a current value $i_o$ detected by the current detector 225 or a position signal H sensed by the position sensor 235. For example, the controller 210 may detect amount of laundry based on a current value $i_o$ of the motor 230 during accelerated rotation of the drum 122.

The controller 210 may also function to detect unbalance of the drum 122, i.e. unbalance (UB) of the drum 122. Detection of unbalance may be implemented based on a current value $i_o$ of the motor 230 during constant velocity rotation of the drum 122. In particular, detection of unbalance may be implemented based upon variation in the rate of rotation of the drum 120 or a ripple component of a current value $i_o$ detected by the current detector 220.

Figure 3:
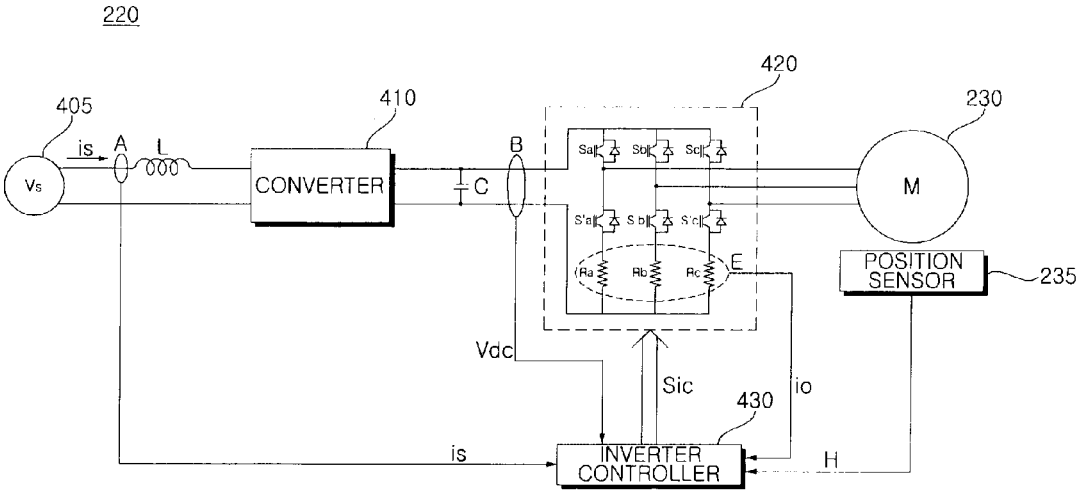
FIG. 3 is an internal circuit diagram of a drive unit shown in FIG. 2.

FIG. 3 is an internal circuit diagram of the drive unit shown in FIG. 2.

Referring to FIG. 3, the drive unit 220 according to an embodiment of the present invention may include a converter 410, an inverter 420, an inverter controller 430, a DC terminal voltage detector B, a smoothing capacitor C, and an output current detector E. In addition, the drive unit 220 may further include an input current detector A and a reactor L, for example.

The reactor L is located between a commercial AC power source (405, $v_s$) and the converter 410 and implements power factor correction or boosting. In addition, the reactor L may function to restrict harmonic current due to fast switching.

The input current detector A may detect an input current $i_s$ input from the commercial AC power source 405. To this end, a current transformer (CT), shunt resistor or the like may be used as the input current detector A. The detected input current $i_s$ may be a discrete pulse signal and be input to the controller 430.

Figure 4:
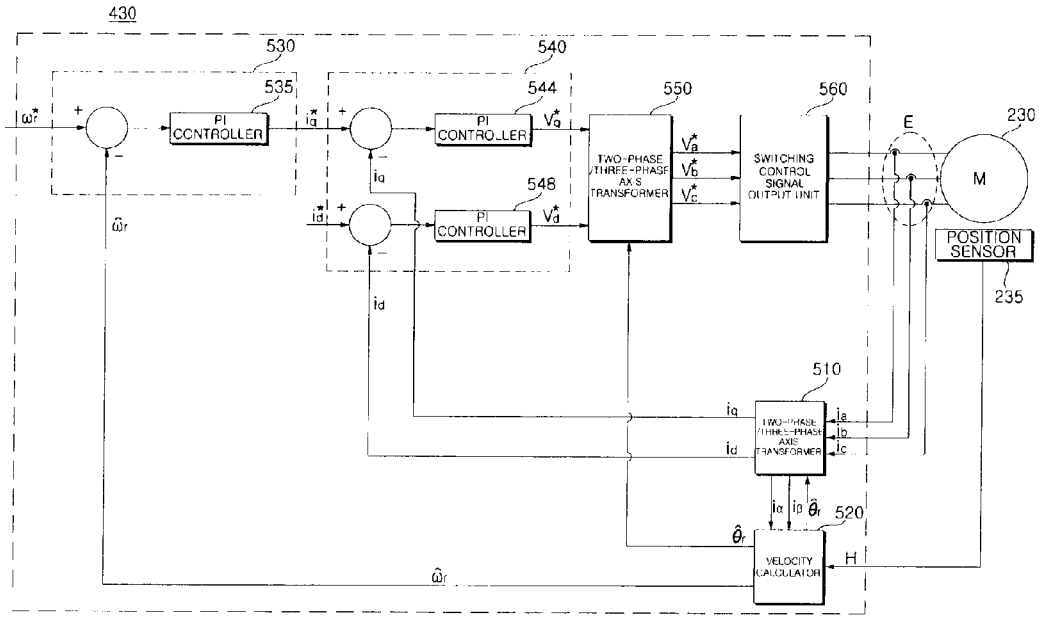
FIG. 4 is an internal block diagram of an inverter controller shown in FIG. 3.

The converter 410 converts and outputs AC power, received from the commercial AC power source 405 and passed through the reactor L, into DC power. FIG. 4 shows the commercial AC power source 405 as a single phase AC power source, but the commercial AC power source 405 may be a three-phase AC power source. Depending on the kind of the commercial AC power source 405, the internal configuration of the converter 410 is altered.

The converter 410 may be constituted of diodes, and the like without a switching element, and implement rectification without switching.

For example, the converter 410 may include four diodes in the form of a bridge assuming a single phase AC power source, or may include six diodes in the form of a bridge assuming three-phase AC power source.

The converter 410 may be a half bridge type converter in which two switching elements and four diodes are interconnected, for example. Under the assumption of a three phase AC power source, the converter 410 may include six switching elements and six diodes.

If the converter 410 includes a switching element, the converter 410 may implement boosting, power factor correction, and DC power conversion via switching by the switching element.

The smoothing capacitor C implements smoothing of input power and stores the same. FIG. 3 shows a single smoothing capacitor C, but a plurality of smoothing capacitors may be provided to achieve stability.

FIG. 3 shows that the smoothing capacitor C is connected to an output terminal of the converter 410, but the present disclosure is not limited thereto, and DC power may be directly input to the smoothing capacitor C. For example, DC power from a solar battery may be directly input to the smoothing capacitor C, or may be DC/DC converted and then input to the smoothing capacitor C. The following description will focus on illustration of the drawing.

Both terminals of the smoothing capacitor C store DC power, and thus may be referred to as a DC terminal or a DC link terminal.

The dc terminal voltage detector B may detect a voltage Vdc at either dc terminal of the smoothing capacitor C. To this end, the dc terminal voltage detector B may include a resistor, an amplifier and the like. The detected dc terminal voltage Vdc may be a discrete pulse signal and be input to the inverter controller 430.

The inverter 420 may include a plurality of inverter switching elements, and convert smoothed DC power Vdc into a predetermined frequency of three-phase AC power va, vb, vc via On/off switching by the switching elements to thereby output the same to the three-phase synchronous motor 230.

The inverter 420 includes a pair of upper arm switching elements Sa, Sb, Sc and lower arm switching elements S'a, S'b, S'c which are connected in series, and a total of three pairs of upper and lower arm switching elements Sa & S'a, Sb & S'b, Sc & S'c are connected in parallel. Diodes are connected in anti-parallel to the respective switching elements Sa, S'a, Sb, S'b, Sc, S'c.

The switching elements included in the inverter 420 are respectively turned on or off based on an inverter switching control signal Sic from the inverter controller 430. Thereby, three-phase AC power having a predetermined frequency is output to the three-phase synchronous motor 230.

The inverter controller 430 may control switching in the inverter 420. To this end, the inverter controller 430 may receive an output current value $i_o$ detected by the output current detector E.

To control switching in the inverter 420, the inverter controller 430 outputs an inverter switching control signal Sic to the inverter 420. The inverter switching control signal Sic is a PWM switching control signal, and is generated and output based on an output current value $i_o$ detected by the output current detector E. A detailed description related to output of the inverter switching control signal Sic in the inverter controller 430 will follow with reference to FIG. 4.

The output current detector E detects an output current $i_o$ flowing between the inverter 420 and the three-phase synchronous motor 230. That is, the output current detector E detects a current flowing through the motor 230. The output current detector E may detect each phase output current ia, ib, ic, or may detect a two-phase output current using three-phase balance.

The output current detector E may be located between the inverter 420 and the motor 230. To detect a current, a current transformer (CT), shunt resistor, or the like may be used as the output current detector E.

Assuming use of a shunt resistor, three shunt resistors may be located between the inverter 420 and the synchronous motor 230, or may be respectively connected at one end thereof to the three lower arm switching elements S'a, S'b, S'c. Alternatively, two shunt resistors may be used based on three-phase balance. Yet alternatively, assuming use of a single shunt resistor, the shunt resistor may be located between the above-described capacitor C and the inverter 420.

The detected output current $i_o$ may be a discrete pulse signal, and be applied to the inverter controller 430. Thus, the inverter switching control signal Sic is generated based on the detected output current $i_o$. The following description will explain that the detected output current $i_o$ is three-phase output current ia, ib, ic.

The three-phase synchronous motor 230 includes a stator and a rotor. The rotor is rotated as a predetermined frequency of each phase AC power is applied to a coil of the stator having each phase a, b, c.

The motor 230, for example, may include a Surface Mounted Permanent Magnet Synchronous Motor (SMPMSM), Interior Permanent Magnet Synchronous Magnet Synchronous Motor (IPMSM), or Synchronous Reluctance Motor (SynRM). Among these motors, the SMPMSM and the IPMSM are Permanent Magnet Synchronous Motors (PMSMs), and the SynRM contains no permanent magnet.

Assuming that the converter 410 includes a switching element, the inverter controller 430 may control switching by the switching element included in the converter 410. To this end, the inverter controller 430 may receive an input current $i_s$ detected by the input current detector A. In addition, to control switching in the converter 410, the inverter controller 430 may output a converter switching control signal Scc to the converter 410. The converter switching control signal Scc may be a PWM switching control signal and may be generated and output based on an input current $i_s$ detected by the input current detector A.

The position sensor 235 may sense a position of the rotor of the motor 230. To this end, the position sensor 235 may include a hall sensor. The sensed position of the rotor H is input to the inverter controller 430 and used for velocity calculation.

FIG. 4 is an internal block diagram of the inverter controller shown in FIG. 3.

Referring to FIG. 4, the inverter controller 430 may include an axis transformer 510, a velocity calculator 520, a current command generator 530, a voltage command generator 540, an axis transformer 550, and a switching control signal output unit 560.

The axis transformer 510 receives three-phase output current ia, ib, ic detected by the output current detector E, and converts the same into two-phase current iα, iβ of an absolute coordinate system.

The axis transformer 510 may transform the two-phase current iα, iβ of an absolute coordinate system into two-phase current id, iq of a polar coordinate system.

The velocity calculator 520 may calculate a velocity $\hat{\omega}_r$ based on a rotor position signal H input from the position sensor 235. That is, based on the position signal, the velocity may be calculated via division with respect to time.

The velocity calculator 520 may output a position $\hat{\theta}_r$ and a velocity $\hat{\omega}_r$, both of which are calculated based on the input rotor position signal H.

The current command generator 530 calculates a velocity command value $\omega^*_r$ based on the calculated position $\hat{\theta}_r$ and a target velocity w, and generates a current command value $i^*_q$ based on the velocity command value $\omega^*_r$. For example, the current command generator 530 may generate the current command value $i^*_q$ based on the velocity command value $w^*_r$ that a difference between the calculated velocity $\hat{\omega}_r$ and the target velocity ω while a PI controller 535 implements PI control. Although the drawing shows a q-axis current command value $i^*_q$ as the current command value, alternatively, a d-axis current command value $i^*_d$ may be further generated. The d-axis current command value $i^*_d$ may be set to zero.

The current command generator 530 may include a limiter (not shown) that limits the level of the current command value $i^*_q$ to prevent the current command value $i^*_q$ from exceeding an allowable range.

Next, the voltage command generator 540 generates d-axis and q-axis voltage command values $v^*_d$, $v^*_q$ based on d-axis and q-axis current $i_d$, $i_q$, which have been axis-transformed into a two-phase polar coordinate system by the axis transformer 510, and the current command values $i^*_d$, $i^*_q$ from the current command generator 530. For example, the voltage command generator 540 may generate the q-axis voltage command value $v^*_q$ based on a difference between the q-axis current $i_q$ and the q-axis current command value $i^*_q$ while a PI controller 544 implements PI control. In addition, the voltage command generator 540 may generate the d-axis voltage command value $v^*_d$ based on a difference between the d-axis current $i_d$ and the d-axis current command value $i^*_d$ while a PI controller 548 implements PI control. The d-axis voltage command value $v^*_d$ may be set to zero to correspond to the d-axis current command value $i^*_d$ that is set to zero.

The voltage command generator 540 may include a limiter (not shown) that limits the level of the d-axis and q-axis voltage command values $v^*_d$, $V^*_q$ to prevent these voltage command values $v^*_d$, $v^*_q$ from exceeding an allowable range.

The generated d-axis and q-axis voltage command values $v^*_d$, $v^*_q$ are input to the axis transformer 550.

The axis transformer 550 receives the calculated position $\hat{\theta}_r$ from the velocity calculator 520 and the d-axis and q-axis voltage command values $v^*_d$, $v^*_q$ to implement axis transformation of the same.

First, the axis transformer 550 implements transformation from a two-phase polar coordinate system into a two-phase absolute coordinate system. In this case, the calculated position $\hat{\theta}_r$ from the velocity calculator 520 may be used.

The axis transformer 550 implements transformation from the two-phase absolute coordinate system into a three-phase absolute coordinate system. Through this transformation, the axis transformer 550 outputs three-phase output voltage command values v*a, v*b, v*c.

The switching control signal output unit 560 generates and outputs a PWM inverter switching control signal Sic based on the three-phase output voltage command values v*a, v*b, v*c.

The output inverter switching control signal Sic may be converted into a gate drive signal by a gate drive unit (not shown), and may then be input to a gate of each switching element included in the inverter 420. Thereby, the respective switching elements Sa, S'a, Sb, S'b, Sc, S'c included in the inverter 420 implement switching.

In the embodiment of the present invention, the switching control signal output unit 560 may generate and output an inverter switching control signal Sic as a mixture of two-phase PWM and three-phase PWM inverter switching control signals.

For example, the switching control signal output unit 560 may generate and output a three-phase PWM inverter switching control signal Sic in an accelerated rotating section that will be described hereinafter, and generate and output a two-phase PWM inverter switching control signal Sic in a constant velocity rotating section in order to detect back electromotive force.

Figure 5:
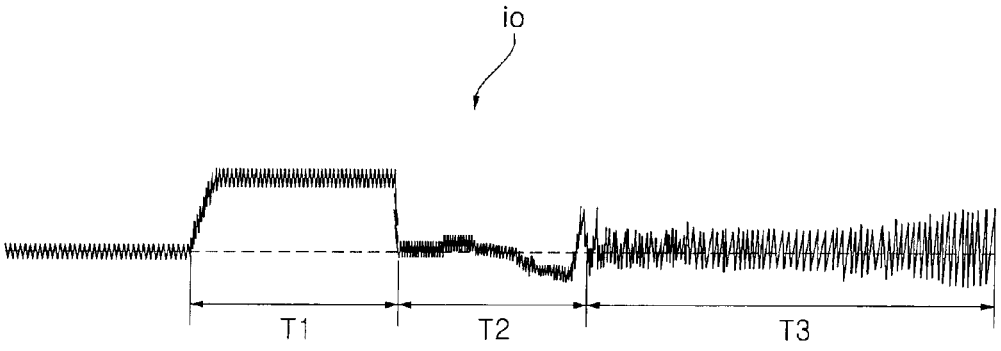
FIG. 5 is a view showing one example of alternating current supplied to a motor shown in FIG. 4.

FIG. 5 is a view showing one example of alternating current supplied to the motor of FIG. 4.

Referring to FIG. 5, a current flowing through the motor 230 depending on switching in the inverter 420 is shown.

More specifically, an operation section of the motor 230 may be divided into a start-up operation section T1 as an initial operation section and a normal operation section T3 after initial start-up operation.

The start-up operation section T1 may be referred to as a motor alignment section during which a constant current is applied to the motor 230. That is, to align the rotor of the motor 230 that remains stationary at a given position, any one switching element among the three upper arm switching elements of the inverter 420 is turned on, and the other two lower arm switching elements, which are not paired with the turned-on upper arm switching element, are turned on.

The magnitude of constant current may be several A. To supply the constant current to the motor 230, the inverter controller 430 may apply a start-up switching control signal Sic to the inverter 420.

In the embodiment of the present invention, the start-up operation section T1 may be subdivided into a section during which a first current is applied and a section during which a second current is applied.

A forced acceleration section T2 during which the velocity of the motor 230 is forcibly increased may further be provided between the start-up operation section T1 and the normal operation section T3. In this section T2, the velocity of the motor 230 is increased in response to a velocity command without feedback of a current $i_o$ flowing through the motor 230. The inverter controller 430 may output a corresponding switching control signal Sic. In the forced acceleration section T2, feedback control that will be described hereinafter with respect to FIG. 5, i.e. vector control is not implemented.

In the normal operation section T3, a feedback control based on the detected output current $i_o$ as described above with reference to FIG. 4 may be implemented in the inverter controller 430, a predetermined frequency of AC power may be applied to the motor 230. This feedback control may be referred to as vector control.

According to the embodiment of the present invention, the normal operation section T3 may include a constant velocity rotating section for sensing of amount of laundry.

More specifically, during the constant velocity rotating section, a rotational velocity of the drum 122 is set to a constant value, the output current $i_o$ detected during the constant velocity rotating section is fed back, and amount of laundry may be sensed using on a current command value based on the output current $i_o$.

Figure 6:
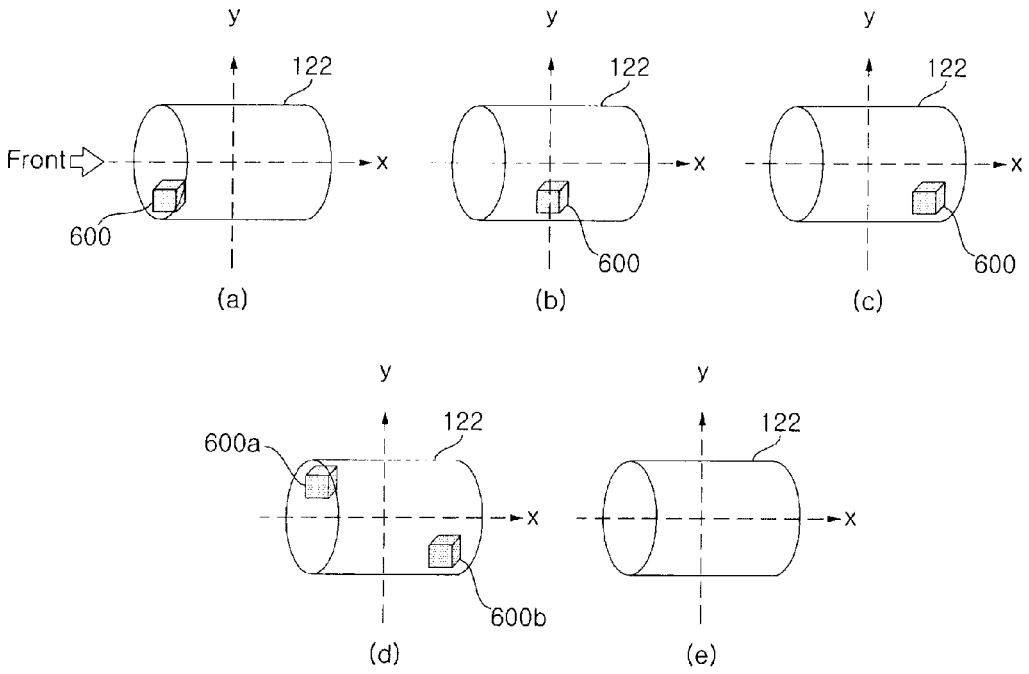
FIG. 6 is a view showing various examples of laundry position within a drum.

FIG. 6 is a view showing various examples of laundry position within the drum.

Referring to FIG. 6, laundry within the drum 122 may be present at various positions. In the embodiment of the present invention, laundry positions may be sorted into approximately five positions.

FIG. 6(*a*) shows that laundry 600 is proximate to the door 113 within the drum 122. This laundry position may be referred to as front-load.

FIG. 6(*b*) shows that the laundry 600 is located in the middle of the drum 122. This laundry position may be referred to as plane-load.

FIG. 6(*c*) shows that the laundry 600 is located at a lateral side of the drum 122, i.e. is distant from the door 113. This laundry position may be referred to as rear-load.

FIG. 6(*d*) shows that laundry 600*a* and 600*b* is spaced apart from each other within the drum 122. In particular, as shown, the first laundry 600*a* is proximate to the door 113 and the second laundry 600*b* is distant from the door 113. This laundry position may be referred to as diagonal-load.

FIG. 6(*e*) shows that the laundry 600 is not present within the drum 122. In this case, the laundry position may be referred to as no-load because laundry is not present within the drum 122. In addition to the case in which no laundry is present as shown in the drawing, the case in which laundry is evenly distributed within the drum 122 may correspond to no-load.

The cases shown in FIGS. 6(*a*) to 6(*c*) differ in terms of laundry positions although laundry amount is constant in all the cases. This may cause different excessive resonance sections or different vibrations in the respective cases during rotation of the drum 122.

In particular, in the case of front-load shown in FIG. 6(*a*), greater vibration and noise occur than in plane-load of FIG. 6(*b*) and rear-load of FIG. 6(*c*). Thus, it is necessary to distinguish front-load from plane-load and rear-load.

It is noted that traditional unbalance sensing methods may sense the same unbalance in both the cases of FIGS. 6(*d*) and 6(*e*). However, diagonal-load and no-load differ in terms of the presence or absence of load, and in particular, diagonal-load causes substantial vibration and noise. Therefore, it is necessary to distinguish diagonal-load from no-load.

The embodiment of the present invention enables implementation of an operation suitable for the laundry treatment machine via sensing of laundry position. In particular, sensing of an unbalance occurrence position is more necessary upon dehydration. Sensing of laundry position ensures stable operation of the laundry treatment machine.

Laundry position sensing methods will hereinafter be described with reference to FIG. 7 and the following drawings.

Figure 7A:
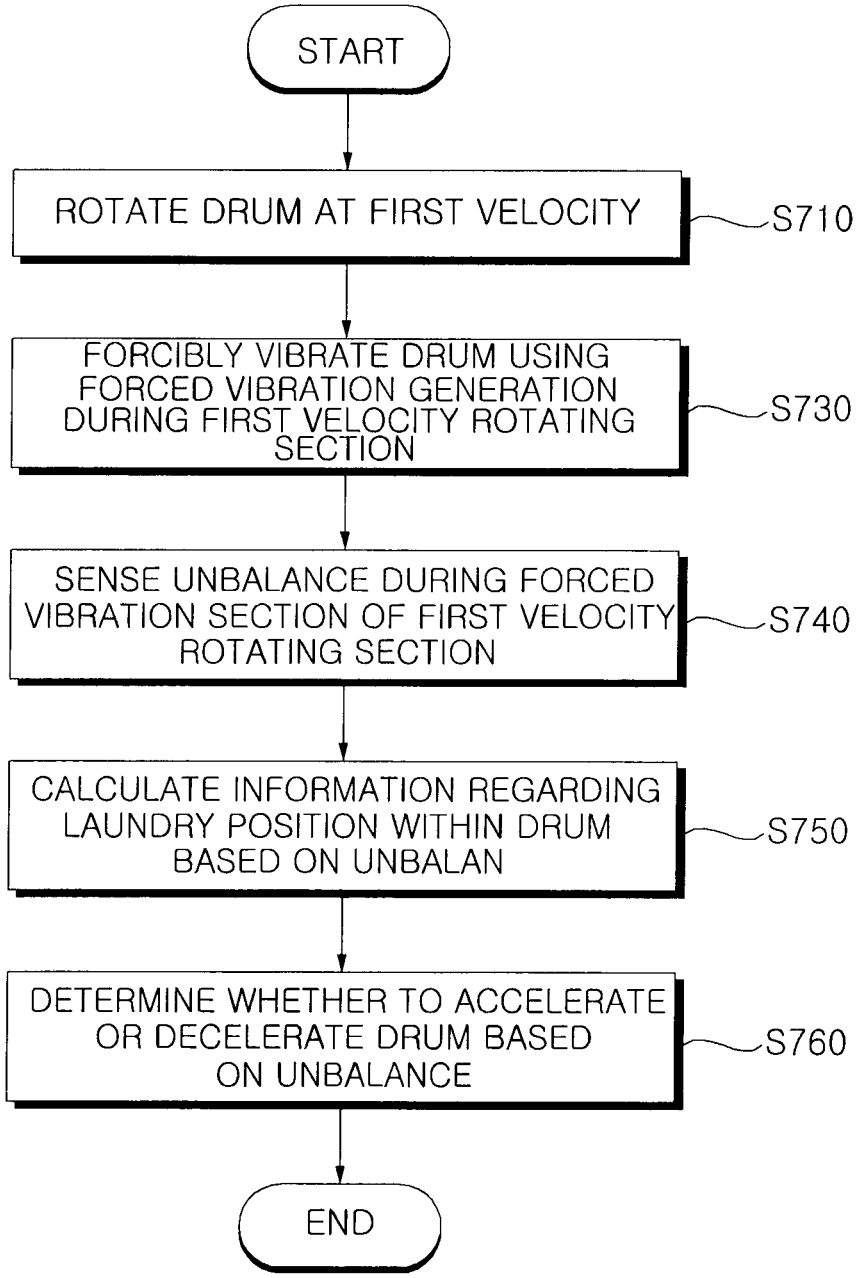
FIG. 7A is a flowchart showing a method of operating a laundry treatment machine according to one embodiment of the present invention.
Figure 7B:
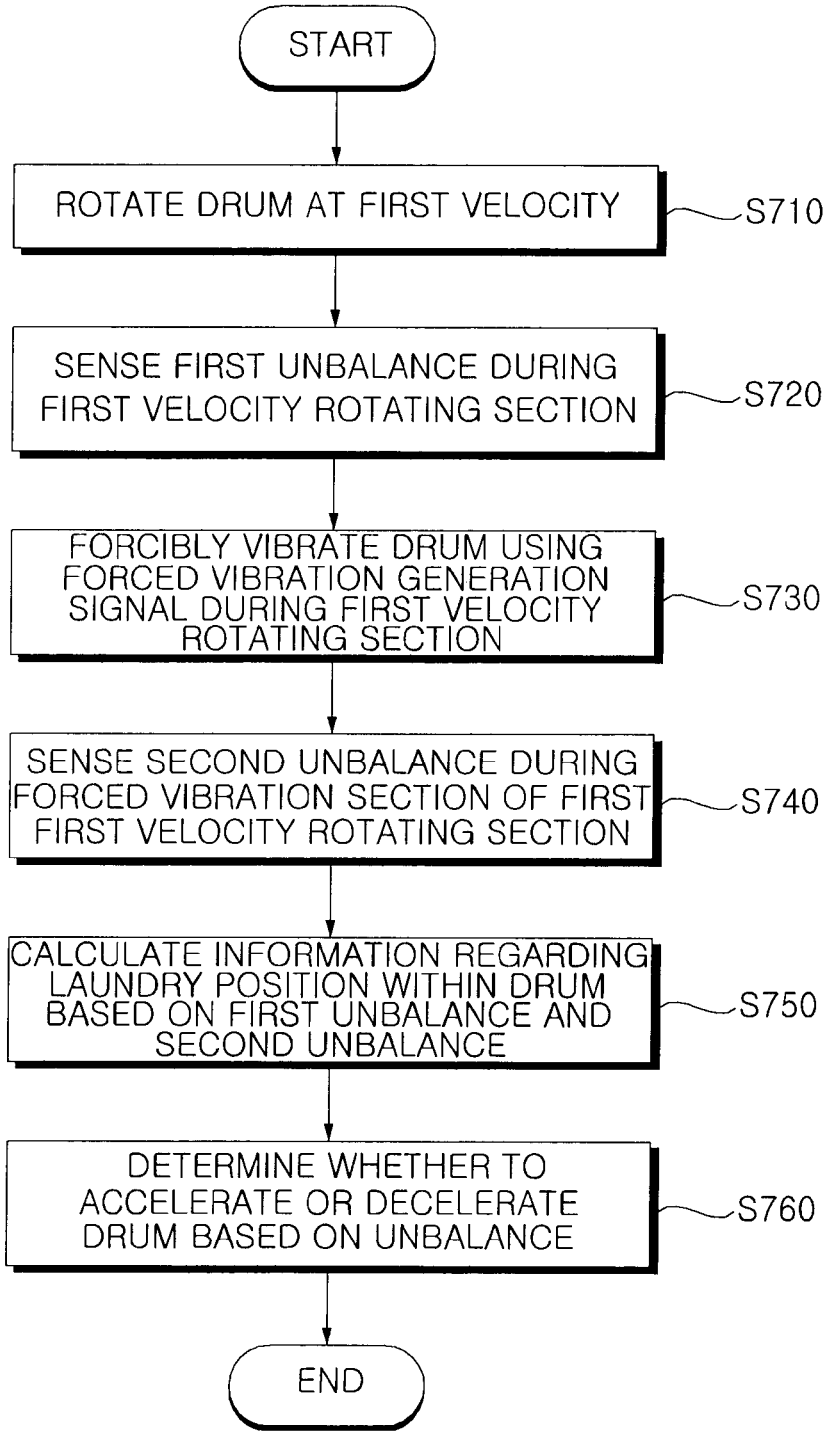
FIG. 7B is a flowchart showing a method of operating a laundry treatment machine according to another embodiment of the present invention.

FIG. 7A is a flowchart showing a method of operating a laundry treatment machine according to one embodiment of the present invention, and FIG. 7B is a flowchart showing a method of operating a laundry treatment machine according to another embodiment of the present invention, and FIGS. 8 to 17 are reference views for explanation of the operating method of FIG. 7A or 7B.

First, FIG. 7A shows a first embodiment of the present invention.

Referring to FIG. 7A, according to the embodiment of the present invention, the drive unit 220 of the laundry treatment machine 100 rotates the drum 122 at a first velocity (S710).

Specifically, the drive unit 220 rotates the drum 122 at a first velocity ω1, in order to sense laundry position. To this end, a target velocity $\omega_r$ is set to the first velocity ω1, and the inverter controller 430 may implement vector control to follow the target velocity $\omega_r$. That is, feedback control may be implemented based on an output current and a position signal sensed by the output current detector E and the position sensor 235. Thereby, the drum 122 is rotated at an approximately constant first velocity ω1.

The first velocity ω1 may have various values, but is preferably a velocity at which laundry is adhered to a circumferential surface of the drum 122. The first velocity ω1 may have any one value within a range of approximately 80 rpm to 120 rpm.

Next, the drive unit 220 forcibly vibrates the drum 122 using a forced vibration generation signal during a first velocity rotating section (S730).

Figure 9:
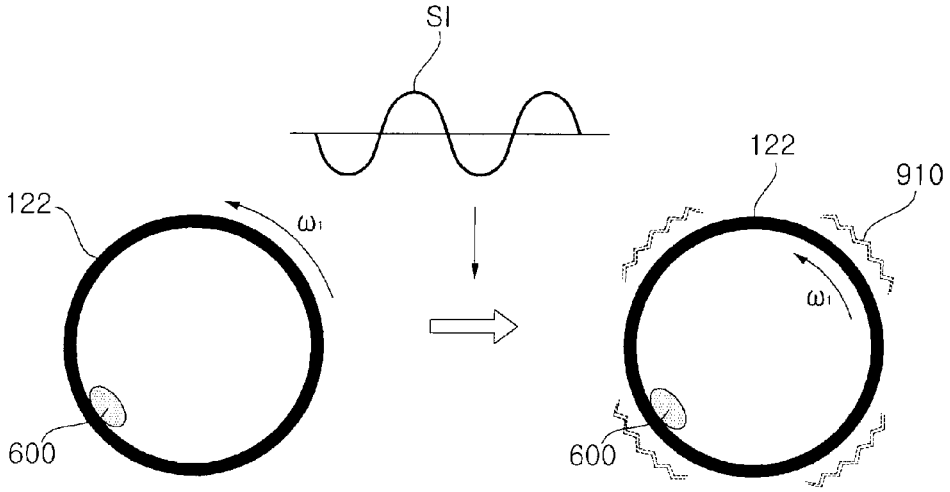

Referring to FIG. 9, while the drum 122, into which laundry 600 has been introduced, is implementing constant velocity rotation at the first velocity ω1, the drive unit 220 inputs a forced vibration generation signal SI, which corresponds to a resonance band frequency of the laundry treatment machine, as an operation command value. Here, the resonance band frequency may correspond to a velocity within a range of 250 rpm to 400 rpm.

In response to the input forced vibration generation signal SI, forced vibration 910 of the drum 122 occurs while the drum 122 is being rotated at the first velocity ω1.

Herein, the forced vibration generation signal SI refers to a resonance frequency signal corresponding to a rotational velocity band in which the drum 122 or the tub 120 resonates under the assumption that the drum 122 is rotated at low RPM. The resonance frequency signal may be a current signal or a voltage signal, for example.

If the forced vibration generation signal SI is added, as an operation command value, to the drum 122 that is being rotated at a constant velocity, additional forced vibration occurs during constant velocity rotation.

The embodiment of the present invention provides rapid prediction of laundry position and amount using the above-described forced vibration. That is, after input of the forced vibration generation signal SI, unbalance of laundry is sensed, which enables rapid prediction of laundry position and amount.

Through the above-described method, rapid prediction of laundry position and amount may be accomplished without addition of separate hardware, such as, for example, a vibration sensor.

It is noted that likelihood of resonance is low because there is substantially no motor noise and forced vibration is less than excessive vibration despite input of the forced vibration generation signal SI.

The forced vibration generation signal SI may be a current command value for forced vibration generation, a velocity command value for forced vibration generation, and a voltage command value for forced vibration generation, for example.

Figure 10:
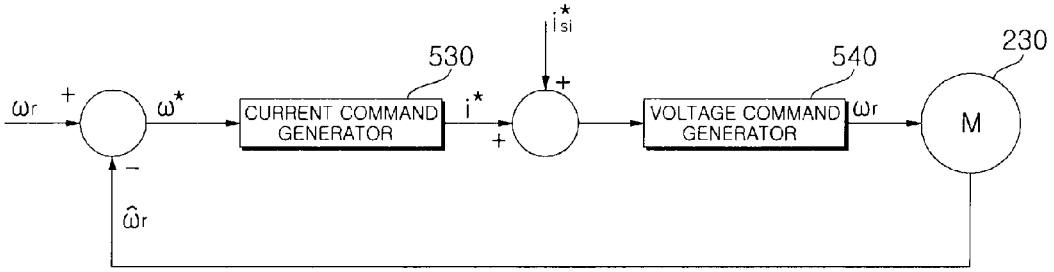

FIG. 10 shows use of a current command value for forced vibration generation as the forced vibration generation signal SI.

FIG. 10 is a simplified internal block diagram of the inverter controller 430 of FIG. 4. Referring to FIG. 10, the inverter controller 430 adds a current command value for forced vibration generation $i^*_{si}$ to a current command value i* output from the current command generator 530, thereby inputting the forced vibration generation signal SI.

Thereby, the voltage command generator 540 outputs a voltage command value based on the sum of a current command value for rotation at the first velocity ω1 and the current command value for forced vibration generation $i^*_{si}$. In conclusion, the inverter 420 is driven based on the voltage command value, whereby the motor 230 forcibly vibrates at the first velocity ω1.

Figure 11:
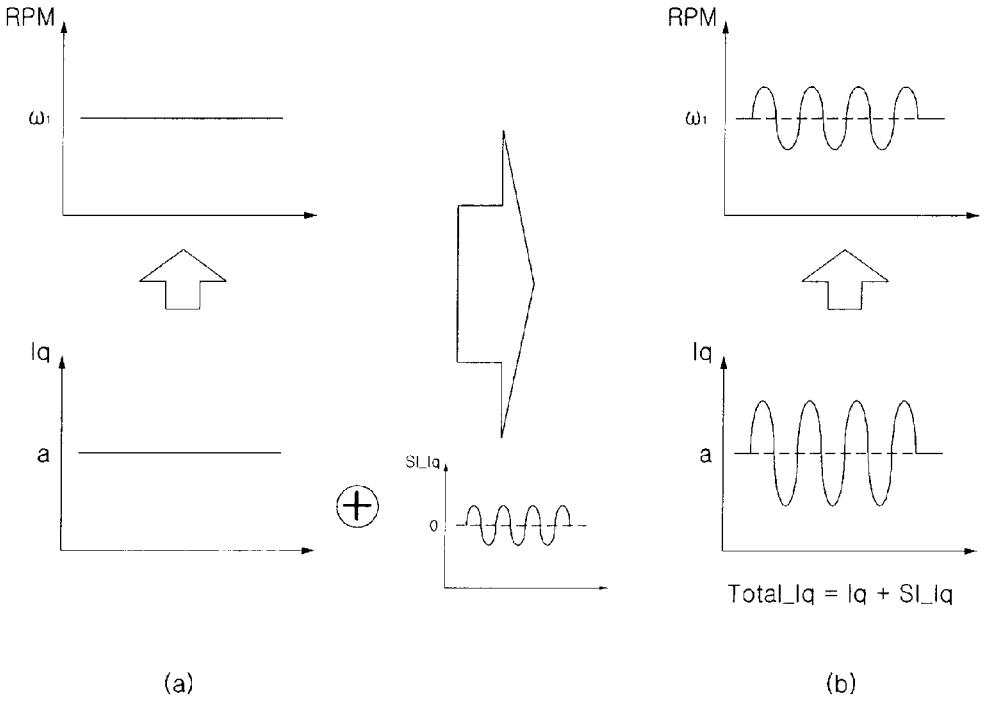

As exemplarily shown in FIG. 11(*a*), if a d-axis current command value i*d among current command values for rotation at the first velocity ω1 is set to zero as described above in FIG. 4, the motor 230 is rotated at the first velocity ω1 based on a q-axis current command value $i^*_q$.

In this case, if a current command value for q-axis forced vibration generation SI_Iq is added, as exemplarily shown in FIG. 11(*b*), the motor 230 forcibly vibrates at the first velocity ω1 while being rotated at the first velocity ω1, based on a total command value Total_iq that is the sum of the q-axis current command value $i^*_q$ and the current command value for q-axis forced vibration generation SI_Iq.

Figure 16:
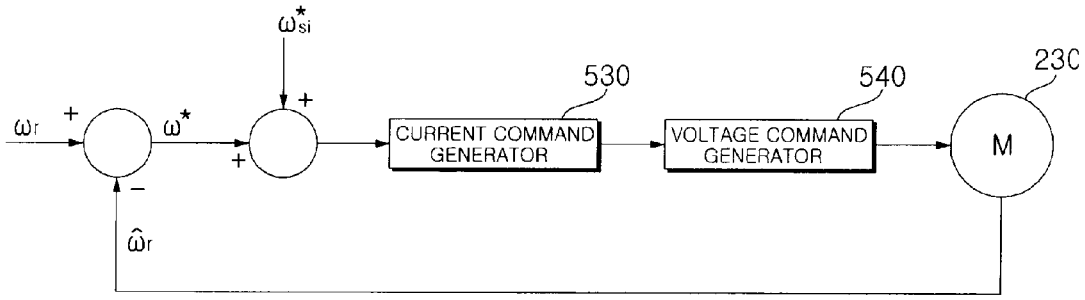

FIG. 16 shows use of a velocity command value for forced vibration generation as the forced vibration generation signal SI.

FIG. 16 is a simplified internal block diagram of the inverter controller 430 of FIG. 4. Referring to FIG. 16, the inverter controller 430 adds a velocity command value for forced vibration generation $\omega^*_{si}$ to a velocity command value $\omega_r$, thereby inputting the forced vibration generation signal SI.

Thereby, the current command generator 530 generates a current command value based on the sum of a velocity command value $\omega_r$ for rotation at the first velocity ω1 and the velocity command value for forced vibration generation $\omega^*_{si}$. In addition, the voltage command generator 540 outputs a voltage command value based on a current command value. In conclusion, the inverter 420 is driven based on the voltage command value, whereby the motor 230 forcibly vibrates at the first velocity ω1 while being rotated at the first velocity ω1.

Figure 17:
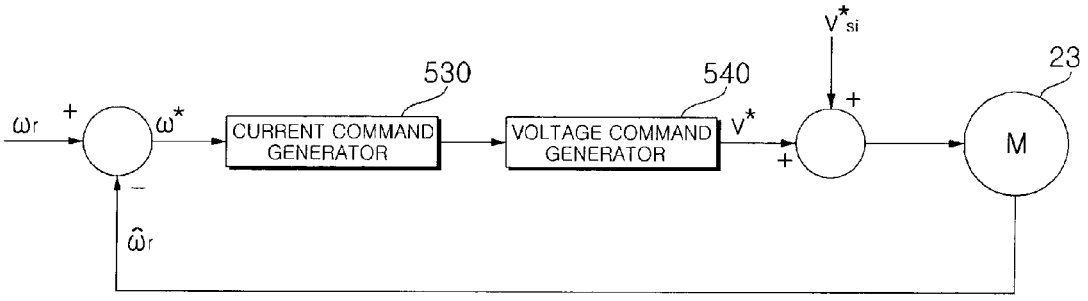

FIG. 17 shows use of a voltage command value for forced vibration generation as the forced vibration generation signal SI.

FIG. 17 is a simplified internal block diagram of the inverter controller 430 of FIG. 4. Referring to FIG. 17, the inverter controller 430 adds a voltage command value for forced vibration generation $v^*_{si}$ to a voltage command value $v_r$, thereby inputting the forced vibration generation signal SI.

Thereby, the inverter 420 is driven based on the sum of the voltage command value $v_r$ and the voltage command value for forced vibration generation $v^*_{si}$, whereby the motor 230 forcibly vibrates at the first velocity ω1 while being rotated at the first velocity ω1.

The forced vibration generation signal SI, as exemplarily shown in FIG. 11, may have a constant level and constant frequency (e.g., a frequency of approximately 4 Hz corresponding to 300 rpm), but various other examples are possible.

Figure 14:
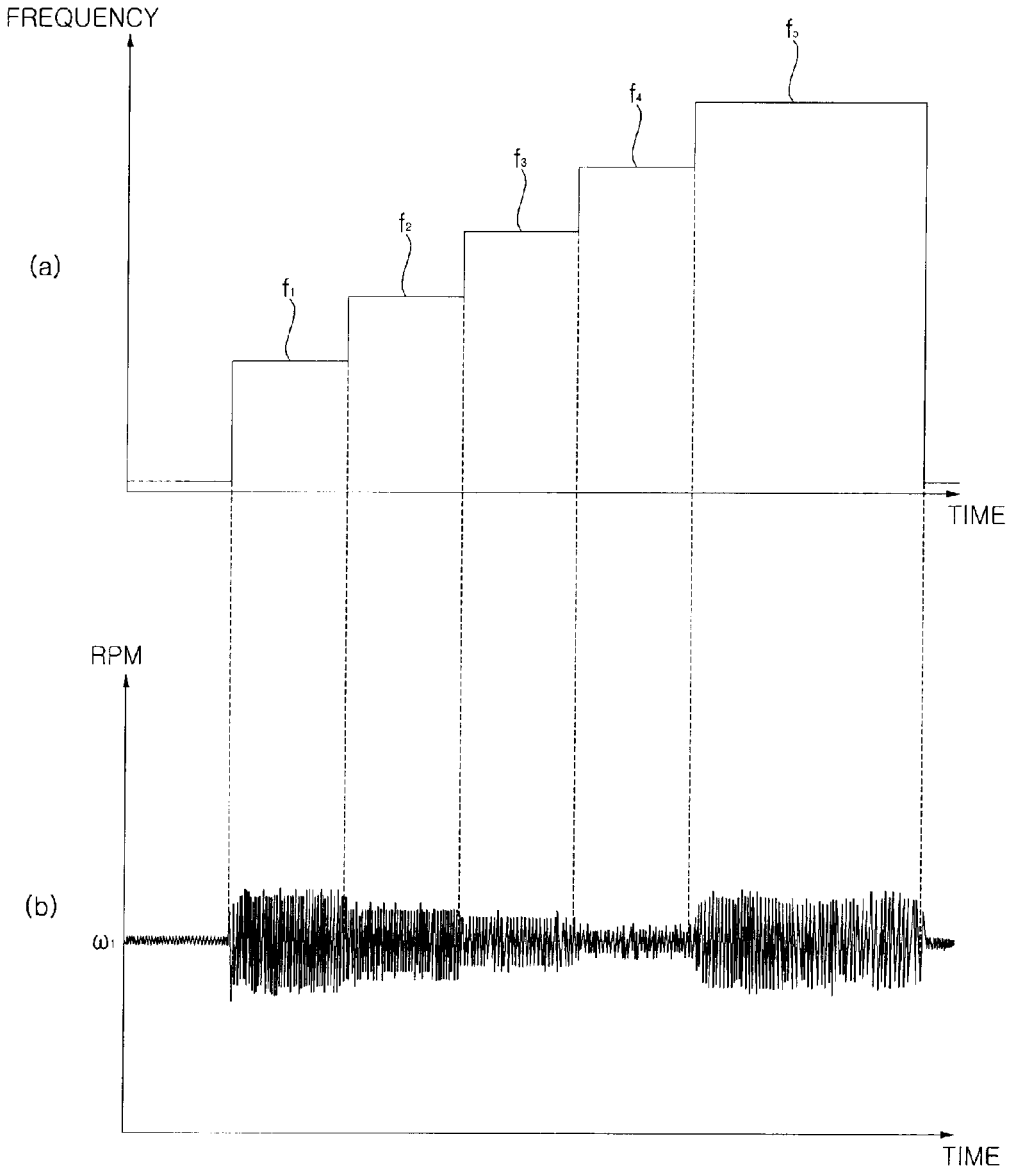

In one example, as exemplarily shown in FIG. 14(*a*), a frequency of the forced vibration generation signal SI may increase stepwise. The frequency may increase stepwise from approximately 3 Hz to approximately 7 Hz (corresponding to a range of 200 rpm to 450 rpm). As such, the drum 122, as exemplarily shown in FIG. 14(*b*), forcibly vibrates at the first velocity ω1. The drum 122 exhibits different forced vibration characteristics on a per frequency basis.

Laundry position may be determined upon sensing of unbalance using different forced vibration characteristics on a per frequency basis. For example, laundry position may be determined using an average value of eccentricities sensed on a per frequency basis.

Figure 15:
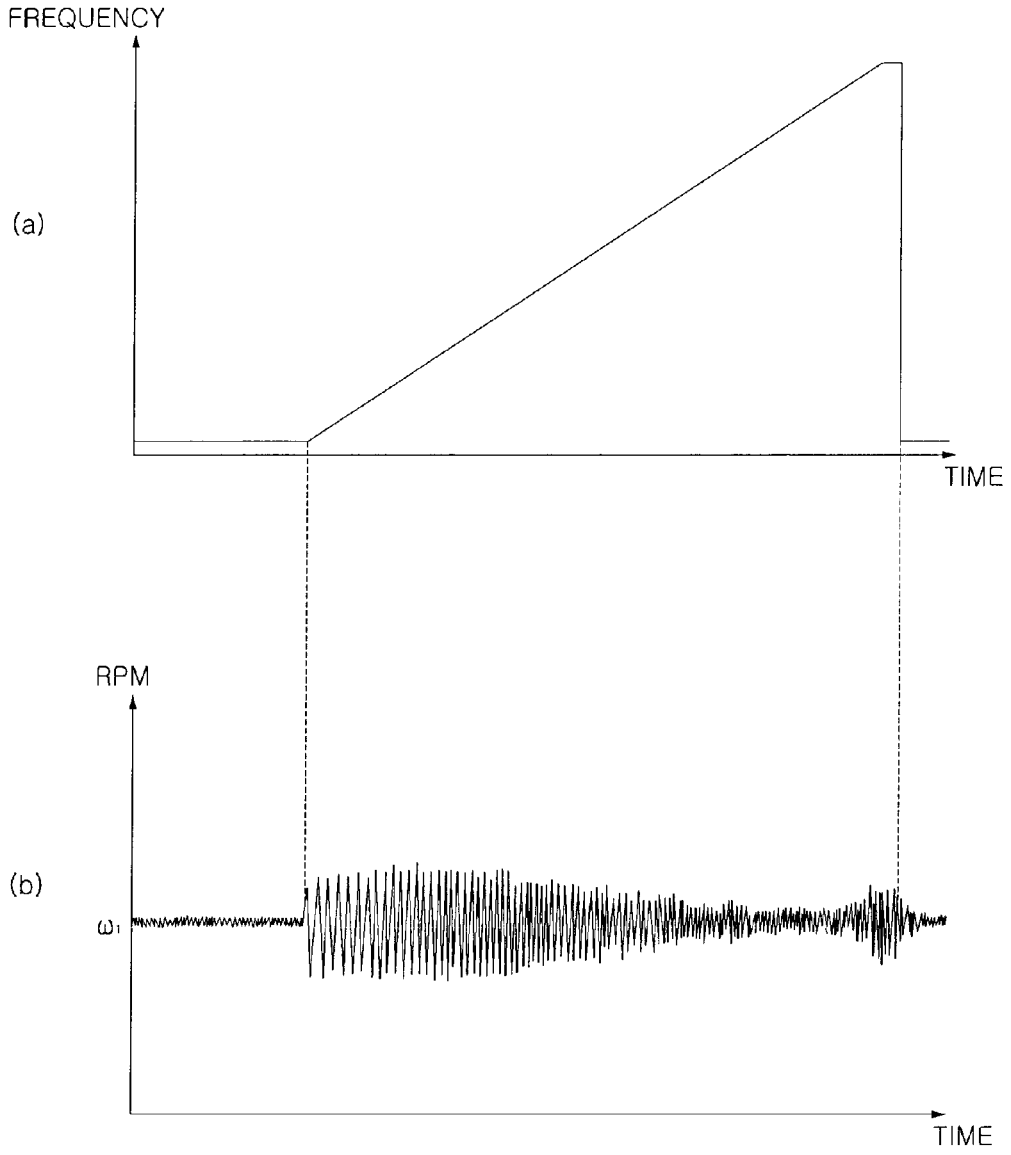

In another example, as exemplarily shown in FIG. 15(*a*), the frequency of the forced vibration generation signal SI may sequentially increase from approximately 3 Hz to approximately 7 Hz. As such, the drum 122, as exemplarily shown in FIG. 15(*b*), forcibly vibrates at the first velocity ω1. The drum 122 exhibits different forced vibration characteristics on a per frequency basis.

Laundry position may be determined upon sensing of unbalance using different forced vibration characteristics on a per frequency basis. For example, laundry position may be determined using an average value of eccentricities sensed on a per frequency basis.

Next, the controller 210 or the inverter controller 430 in the drive unit 220 senses unbalance during a forced vibration section that is included in the first velocity rotating section (S740). Then, the controller 210 or the inverter controller 430 in the drive unit 220 calculates information regarding laundry position within the drum 122 (S750). Then, the controller 210 or the inverter controller 430 in the drive unit 220 determines whether to decelerate or accelerate the drum 122 after rotation at the first velocity based on the sensed unbalance (S760).

The controller 210 senses unbalance during the forced vibration section in response to the input forced vibration generation signal during constant velocity rotation of the drum 122 at the first velocity ω1.

In one example, unbalance may be sensed based upon variation of the sensed velocity during rotation at the first velocity ω1, a difference between the maximum velocity and the minimum velocity, an average velocity value, and the like.

In another example, unbalance may be sensed based upon variation of the velocity command value ω* during rotation at the first velocity ω1, a difference between the maximum command value and the minimum command value, an average command value, and the like.

In a further example, unbalance may be sensed based upon variation of the current command value during rotation at the first velocity ω1, a difference between the maximum command value and the minimum command value, an average command value, and the like. Here, if a d-axis current command value $i^*_d$ is set to zero as described above in FIG. 4, the current command value may be a q-axis current command value $i^*_q$.

In a still further example, unbalance may be sensed based upon variation of the voltage command value ω* during rotation at the first velocity ω1, a difference between the maximum command value and the minimum command value, an average command value, and the like. Here, if a d-axis current command value $i^*_d$ is set to zero as described above in FIG. 4, the voltage command value may be a q-axis voltage command value $q^*_q$.

Figure 8:
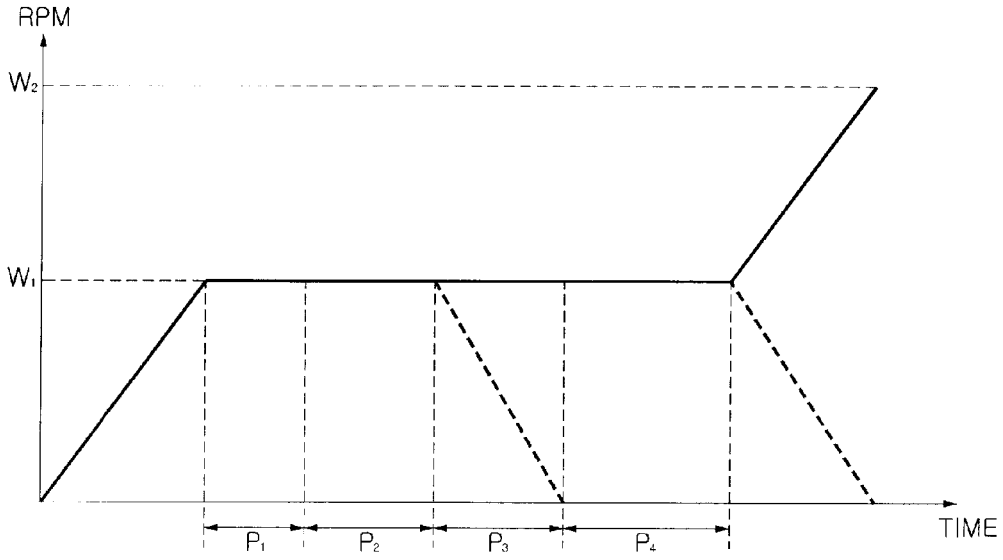
FIGS. 8 to 17 are reference views for explanation of the operating method of FIG. 7A or 7B.

FIG. 8 shows that the drum 122 is accelerated from a static state to the first velocity ω1, and then implements constant velocity rotation at the first velocity ω1. Thereafter, the drum 122 is again accelerated to a second velocity ω2 if unbalance sensed during a first velocity rotating section is less than an allowable value.

In this case, the first velocity rotating section may be divided into four sections as exemplarily shown in FIG. 8. A first section P1 is a stabilization section during which the drum 122 that has accelerated to the first velocity ω1 is stabilized. A second section P2 is a primary unbalance sensing section of the first velocity rotating section and corresponds to step S720. A third section P3 is a stabilization section during which the drum 122 is stabilized after primary unbalance sensing. A fourth section P4 corresponds to step S730 and step S740, and is a secondary unbalance sensing section during which the drum 122 that has implemented constant velocity rotation at the first velocity ω1 forcibly vibrates in response to the input forced vibration generation signal and unbalance is secondarily sensed during the forced vibration section.

In FIG. 7A, step S730 and step S740 correspond to the fourth section P4 of FIG. 8.

Figure 12A:
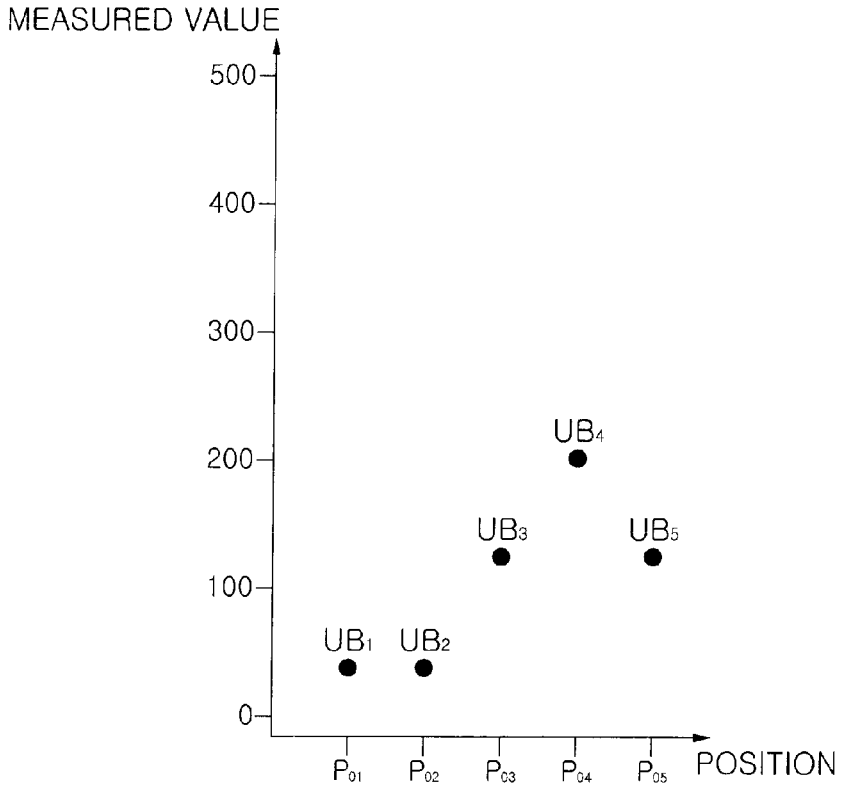
Figure 12B:
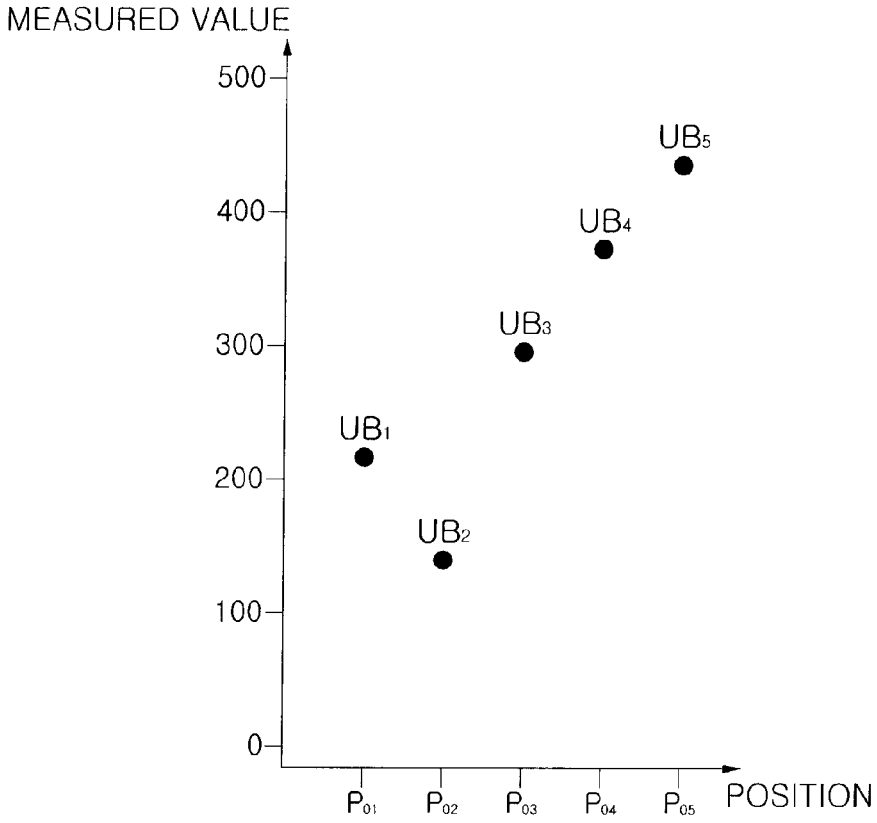

FIG. 12B shows sensed results of unbalance in step S740, i.e. during the fourth section P4 of FIG. 8.

Laundry of a first weight W1 is introduced into the drum 122 to correspond to five load conditions as shown in FIG. 6. Then, if unbalance is sensed during the forced vibration section, as shown in FIG. 12B, unbalance increases in the order of no-load P02, diagonal-load P01, front-load P03, plane-load P04, and rear-load P05 (UB2<UB1<UB3<UB4<UB5).

The controller 210 may distinguish no-load P02, diagonal-load P01, front-load P03, plane-load P04, and rear-load P05 from one another on a per unbalance section basis.

In particular, the respective loads may be distinguished using a table on a per unbalance basis. In this way, information regarding laundry position may be acquired.

The table on a per unbalance basis may be associated with laundry amount because unbalance varies according to laundry amount. That is, an unbalance section may vary according to laundry amount.

The controller 210 may distinguish no-load P02, diagonal-load P01, front-load P03, plane-load P04, and rear-load P05 from one another using unbalance without the table.

Alternatively, the controller 210 may distinguish no-load P02, diagonal-load P01, front-load P03, plane-load P04, and rear-load P05 from one another using sensed amount and sensed unbalance without the table.

In this way, laundry position may be simply determined in response to the input forced vibration generation signal.

If the sensed unbalance is equal to or greater than an allowable value due to forced vibration during the fourth section P4 of FIG. 8, the controller 210 may rotate the drum 122 at a lower velocity than a first velocity ω1. For example, in the cases of diagonal-load P01, front-load P03, plane-load P04, and rear-load P05, the respective sensed eccentricities UB1, UB3, UB4, and UB5 may be equal to or greater than an allowable value (e.g., 200 of FIG. 12B). In this case, the drum 122 may be decelerated and rotated at a lower velocity than the first velocity ω1.

A dotted line in FIG. 8 represents deceleration, i.e. reduction in the rate of rotation for laundry distribution if the sensed unbalance is equal to or greater than an allowable value. The controller 210 may again rotate the drum 122 at the first velocity after a predetermined time has passed.

If the sensed unbalance due to forced vibration during the fourth section P4 of FIG. 8 is less than an allowable value, the controller 210 may accelerate and rotate the drum 122 at a second velocity ω2 higher than the first velocity ω1. For example, in the case of no-load P02, the sensed unbalance UB2 may be less than an allowable value. In this case, as exemplarily shown in FIG. 8, the drum 122 may be accelerated and rotated at the second velocity ω2 higher than the first velocity ω1. In conclusion, differently from the related art, according to the present invention, no-load and diagonal-load may be distinguished, which enables implementation of an operation corresponding to laundry distribution.

Next, FIG. 7B shows a second embodiment of the present invention.

The operating method of FIG. 7B is almost similar to the operating method of FIG. 7A except that it further includes unbalance sensing step S720 and that calculation of information regarding laundry position in step S750 is implemented based on unbalance sensed in step S720 as well as unbalance sensed in step S740.

Referring to FIG. 7B, according to another embodiment of the present invention, the drive unit 220 of the laundry treatment machine 100 rotates the drum 122 at a first velocity ω1 (S710). A description of step S710 will be omitted herein with reference to the description of FIG. 7A.

Next, the controller 210 or the inverter controller 430 in the drive unit 220 senses unbalance during a first velocity rotating section (S720).

The controller 210 senses unbalance using velocity ripple if velocity ripple is present during a constant velocity rotating section of the drum 122 at the first velocity ω1.

For instance, if laundry within the drum 122 is unbalanced, the drum 122 is not rotated at the first velocity ω1 even if it is attempted to constantly rotate the drum 122 at the first velocity ω1. In practice, the drum 122 may be rotated at a higher velocity than the first velocity ω1, and then be rotated at a lower velocity than the first velocity ω1 according to laundry position, and the like. That is, velocity ripple at the first velocity ω1 may occur. Unbalance sensing may be implemented based on velocity ripple.

In one example, unbalance may be sensed based upon variation of the sensed velocity during rotation at the first velocity ω1, a difference between the maximum velocity and the minimum velocity, an average velocity value, and the like.

In another example, unbalance may be sensed based upon variation of the velocity command value ω* during rotation at the first velocity ω1, a difference between the maximum command value and the minimum command value, an average command value, and the like.

In a further example, unbalance may be sensed based upon variation of the current command value during rotation at the first velocity ω1, a difference between the maximum command value and the minimum command value, an average command value, and the like. Here, if a d-axis current command value $i^*_d$ is set to zero as described above in FIG. 4, the current command value may be a q-axis current command value $i^*_q$.

In a still further example, unbalance may be sensed based upon variation of the voltage command value ω* during rotation at the first velocity ω1, a difference between the maximum command value and the minimum command value, an average command value, and the like. Here, if a d-axis current command value $i^*_d$ is set to zero as described above in FIG. 4, the voltage command value may be a q-axis voltage command value $q^*_q$.

FIG. 12A shows sensed results of unbalance during the second section P2 of FIG. 8, i.e. in step S720 of FIG. 7B.

Laundry of a first weight W1 is introduced into the drum 122 to correspond to five load conditions as shown in FIG. 6. Then, if unbalance is sensed during a first velocity rotating section, as shown in FIG. 12A, diagonal-load P01 and no-load P02 have the smallest unbalance. Front-load P01 and rear-load P02 have the secondly greatest unbalance, and plane-load P04 has the greatest unbalance.

Referring to FIG. 12A, it will be appreciated that eccentricities UB1 and UB2 of diagonal-load P01 and no-load P02 are almost similar to each other, and eccentricities UB3, UB4, and UB5 of front-load P03, plane-load P04, and rear-load P05 are greater than eccentricities UB1 and UB2 of diagonal-load P01 and no-load P02.

In FIG. 12A, eccentricities of diagonal-load P01 and no-load P02 are almost similar to each other, and therefore it is necessary to distinguish diagonal-load P01 and no-load P02 from each other. Moreover, it is necessary to distinguish front-load P03, plane-load P04, and rear-load P05 from one another. This will hereinafter be described with reference to step S730 and step S740.

The controller 210 may decelerate and rotate the drum 122 at a lower velocity than the first velocity ω1 if unbalance sensed before forced vibration S730 is equal to or greater than an allowable range. Referring to FIG. 8, if unbalance sensed during the second section P2 is equal to or greater than an allowable range, deceleration, i.e. reduction in the rate of rotation may be implemented for laundry distribution. In FIG. 8, a dotted line represents reduction in the rate of rotation for laundry distribution if the sensed unbalance is equal to or greater than an allowable value. The controller 220 may again rotate the drum 122 at the first velocity ω1 after a predetermined time has passed.

Next, the drive unit 220 causes forced vibration of the drum 122 using the forced vibration generation signal during the first velocity rotating section (S730). Next, the controller 210 or the inverter controller 430 in the drive unit 220 senses second unbalance during the forced vibration section of the first velocity rotating section (S740). A description of step S730 and step S740 will be omitted herein with reference to the description of FIG. 7A.

Next, the controller 210 or the inverter controller 430 in the drive unit 220 calculates information regarding laundry position within the drum 122 based on the unbalance sensed in step S720 and the unbalance sensed in step S740 (S750). The controller 210 or the inverter controller 430 in the drive unit 220 determines whether to accelerate or decelerate the drum 122 after rotation at the first velocity based on the sensed unbalance (S760). A description of step S760 will be omitted herein with reference to the description of FIG. 7A. The following description will focus on step S750 of FIG. 7B.

More specifically, the controller 210 may calculate information regarding laundry position within the drum 122 based on unbalance sensed before forced vibration and unbalance sensed during forced vibration.

In one example, the controller 210 may sort laundry positions into two groups using unbalance sensed before forced vibration of FIG. 12A. No-load P02 and diagonal-load P01 may be included in a first group, and front-load P3, plane-load P04, and rear-load P05 are included in a second group.

The controller 210 may distinguish no-load P02 and diagonal-load P01 of the first group from each other and distinguish front-load P03, plane-load P04, and rear-load P05 from one another of the second group using unbalance sensed during the forced vibration section of FIG. 12B.

In particular, distinction of eccentricities of no-load P02 and diagonal-load P01 and distinction of eccentricities of front-load P03 and rear-load P05 during the forced vibration section of FIG. 12B enable determination of information regarding laundry position.

In another example, the controller 210 may determine information regarding laundry position based on a difference between unbalance sensed before forced vibration and unbalance sensed during the forced vibration section.

Figure 13:
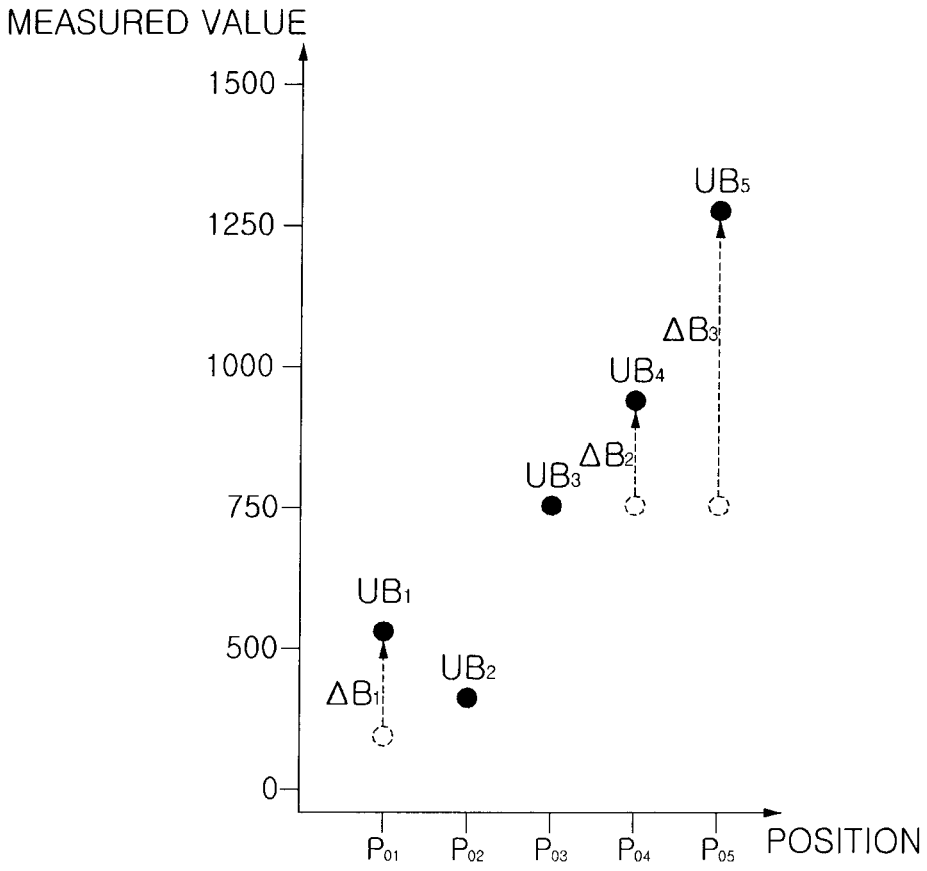

FIG. 13 is a view showing a difference between unbalance sensed before forced vibration and unbalance sensed during the forced vibration section.

Referring to FIG. 13, it will be appreciated that no-load P02 and front-load P03 exhibit substantially no unbalance variation, and diagonal-load P01, plane-load P04, and rear-load P05 exhibit substantial unbalance variation.

Accordingly, the controller 210 may determine any one of no-load P02 and front-load P03 if no unbalance variation occurs, and may also distinguish no-load P02 and front-load P03 from each other based on the magnitude of unbalance.

The controller 210 may determine any one of diagonal-load P01, plane-load P04, and rear-load P05 if no unbalance variation occurs, and may also distinguish diagonal-load P01, plane-load P04, and rear-load P05 in this sequence according to the magnitude of unbalance.

In this way, laundry position may be simply determined in response to the input forced vibration generation signal.

Implementing an operation corresponding to laundry position may achieve reduction in operational time and vibration noise. In conclusion, energy consumption of the laundry treatment machine may be reduced.

The above-described method of sensing laundry position may be implemented during dehydration of the laundry treatment machine 100, but is not limited thereto. This method may be implemented during washing or rinsing.

The laundry treatment machine according to the embodiments of the present invention is not limited to the above described configuration and method of the above embodiments, and all or some of the above embodiments may be selectively combined to achieve various modifications.

The method of operating the laundry treatment machine according to the present invention may be implemented as processor readable code that can be written on a processor readable recording medium included in the laundry treatment machine. The processor readable recording medium may be any type of recording device in which data is stored in a processor readable manner.

As is apparent from the above description, according to an embodiment of the present invention, a laundry treatment machine causes forced vibration of a drum using a forced vibration generation signal while the drum is being rotated at a first velocity. Through forced vibration, it is possible to determine whether to accelerate or decelerate the drum. Moreover, rapid prediction of laundry position and amount may be accomplished. That is, laundry position and amount may be rapidly determined by sensing unbalance of laundry after input of the forced vibration generation signal. Accordingly, operation in consideration of laundry position may be implemented.

Through this method, rapid prediction of laundry position and amount may be accomplished without addition of separate hardware, such as, for example, a vibration sensor.

According to another embodiment of the present invention, unbalance during a first velocity rotating section is sensed before forced vibration, and information regarding laundry position within the drum is calculated based on the unbalance sensed before forced vibration and unbalance sensed during a forced vibration section. In this way, accurate laundry position may be determined. Accordingly, operation in consideration of laundry position may be implemented.

Determination of laundry position enables accurate unbalance sensing, and consequently implementation of a corresponding operation, which may result in reduction in operational time and vibration noise. In conclusion, energy consumed by the laundry treatment machine may be reduced.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method of operating a laundry treatment machine including a drum, rotated by a motor, utilizing a controller disposed in the laundry treatment machine, the method comprising:

rotating the drum at a first velocity based on a first operation command value for rotation at the first velocity;

forcibly vibrating the drum using a resonance frequency signal during the first velocity rotating section, wherein the resonance frequency signal is added to the first operation command value, and wherein the resonance frequency signal corresponds to a rotational velocity band in which the drum resonates during the first velocity rotating section; and accelerating or decelerating the drum based on an output current flowing through the motor after the forced vibration.

2. The method of claim 1, further comprising:

sensing an amount of drum unbalance based on the output current flowing through the motor during the forced vibration section; and calculating a laundry position within the drum based on the amount of drum unbalance.

3. The method of claim 2, further comprising:

sensing unbalance based on the output current flowing through the motor during the first velocity rotating section before the forced vibration, wherein calculation of the laundry position includes calculating the laundry position within the drum based on the amount of drum unbalance sensed before forced vibration and the amount of drum unbalance sensed during the forced vibration section.

4. The method of claim 3, wherein the sensing of the amount of drum unbalance before the forced vibration includes sensing the amount of drum unbalance based on a variation of a velocity command value, a variation of a current command value, a variation of a voltage command value, or a variation in the rate of rotation of the drum for rotation at the first velocity.

5. The method of claim 3, wherein the calculation of the position includes:

sorting, by the controller, the laundry position into a plurality of groups based on the amount of drum unbalance sensed before the forced vibration; and calculating, by the controller, a detailed position in each group based on the amount of drum unbalance sensed during the forced vibration.

6. The method of claim 3, further comprising:

decelerating the drum from the first velocity if the amount of drum unbalance sensed before the forced vibration is equal to or greater than an allowable value.

7. The method of claim 2, wherein the forced vibration of the drum includes forcibly vibrating the drum by adding, by the controller, a current command value for forced vibration generation to a current command value for rotation at the first velocity, and wherein calculation of the position includes calculating the position based on the amount of drum unbalance that corresponds to a variation of the current command value or a variation in the rate of rotation of the drum before and after input of the resonance frequency signal.

8. The method of claim 2, wherein the forced vibration of the drum includes forcibly vibrating the drum by adding, by the controller, a velocity command value for forced vibration generation to a velocity command value for rotation at the first velocity, and wherein calculation of the position includes calculating the position based on the amount of drum unbalance that corresponds to a variation of the velocity command value, a variation in the rate of rotation of the drum, or a variation of a current command value for rotation at the first velocity before and after input of the resonance frequency signal.

9. The method of claim 2, wherein the forced vibration of the drum includes forcibly vibrating the drum by adding, by the controller, a voltage command value for forced vibration generation to a voltage command value for rotation at the first velocity, and wherein calculation of the position includes calculating the position based on the amount of drum unbalance that corresponds to a variation of the voltage command value, a variation in the rate of rotation of the drum, a variation of a current command value for rotation at the first velocity, or a variation of a velocity command value for rotation at the first velocity before and after input of the resonance frequency signal.

10. The method of claim 1, wherein the first velocity is a velocity at which laundry is adhered to a circumferential surface of the drum during rotation of the drum.

11. The method of claim 1, wherein the forced vibration of the drum includes forcibly vibrating the drum by adding an operation command value for forced vibration generation to an operation command value for rotation at the first velocity.

12. The method of claim 11, wherein the command value for forced vibration generation is an operation command value corresponding to a resonance band frequency of the laundry treatment machine.

13. The method of claim 1, wherein a frequency of the resonance frequency signal increases sequentially or stepwise.

* * * * *